US005147199A

United States Patent [19]

Perthuis et al.

[11] Patent Number: 5,147,199

[45] Date of Patent: Sep. 15, 1992

[54] DOUBLE FUEL JET BURNER AND METHOD FOR ITS IMPLEMENTATION

[76] Inventors: Edmond Perthuis, 31 Avenue Robert-Hardouin, F-78220 Viroflay; Francois Audibert, 6, Avenue du Prieure, F-79130 Ecully, both of France

[21] Appl. No.: 610,562

[22] Filed: Nov. 8, 1990

Related U.S. Application Data

[63] Continuation of Ser. No. 249,572, Sep. 22, 1988, abandoned.

[30] Foreign Application Priority Data

Dec. 12, 1986 [FR] France ..... 86 17538
Dec. 11, 1987 [FR] France ..... PCT/FR87/00498

[51] Int. Cl.[5] ..... F23D 14/24

[52] U.S. Cl. ..... 431/10; 431/183; 431/187

[58] Field of Search ..... 431/181, 182, 183, 184, 431/185, 187, 188, 175, 263, 264, 265, 278, 8, 350, 9, 351, 18; 239/400, 403, 425, 558, 559; 60/732, 733, 751, 39, 826

[56] References Cited

U.S. PATENT DOCUMENTS

| | | | |
|---|---|---|---|
| 1,062,714 | 5/1913 | Johnston | 239/559 X |
| 1,799,459 | 4/1931 | Fantz | 431/187 X |
| 2,531,316 | 11/1950 | Zink | 431/188 X |
| 2,753,929 | 7/1956 | Watshim | 431/265 |
| 2,840,152 | 6/1958 | Reed | 431/350 X |
| 2,933,259 | 4/1960 | Raskin | 239/559 X |
| 3,133,731 | 5/1964 | Reed | 431/187 X |
| 3,180,395 | 4/1965 | Reed | 431/285 X |
| 3,308,869 | 3/1967 | Livingston | 431/187 X |
| 3,529,917 | 9/1970 | Hindenlang | 431/188 X |
| 4,180,393 | 4/1965 | Reed | 431/187 |
| 4,197,066 | 4/1980 | Viger | 431/183 X |
| 4,297,093 | 10/1981 | Morimoto et al. | 431/10 |
| 4,439,401 | 3/1984 | Voll et al. | 239/558 X |
| 4,604,048 | 8/1986 | Schwartz . | |
| 4,604,648 | 8/1986 | Schwartz et al. | 431/188 X |

FOREIGN PATENT DOCUMENTS

| | | | |
|---|---|---|---|
| 0163645 | 12/1948 | Fed. Rep. of Germany | 431/187 |
| 2428622 | 1/1975 | Fed. Rep. of Germany . | |
| 2564182 | 11/1985 | France . | |
| 0123737 | 9/1979 | Japan | 431/10 |
| 0149516 | 11/1981 | Japan | 431/182 |

OTHER PUBLICATIONS

Soviet Invention, Illustrated, Section Q, wk.84/M25 Apr. 1984, Derwent Publ. Ltd. see p. 73.

*Primary Examiner*—Carl D. Price
*Attorney, Agent, or Firm*—Antonelli, Terry, Stout & Kraus

[57] ABSTRACT

A burner for a hearth including a gun for introducing a primary comburant and a gun for supplying a secondary comburant, with a device for supplying a gaseous fuel and a deflector stabilizer arranged substantially at an extremity of the gun introducing the primary comburant. The fuel supply device includes a first fuel injector arrangement adapted to produce a first jet of fuel substantially axially or slightly divergent with respect to a longitudinal center axis of the burner, and a second fuel injector arrangement adapted to produce a second jet of fuel divergent with respect to the longitudinal center axis of the burner.

18 Claims, 2 Drawing Sheets

DOUBLE FUEL JET BURNER AND METHOD FOR ITS IMPLEMENTATION

This is a continuation of Ser. No. 249,572, filed Sep. 22, 1988 now abandoned.

BACKGROUND OF THE INVENTION

The present invention relates to a gas burner for a hearth, in particular, for an industrial or domestic hearth, and a process for burning fuel gas with comburant gas.

The present invention is particularly well adapted to gas combustion. However, one would not depart from the scope of the present invention by using an atomized liquid fuel, possibly atomized pneumatically.

The burner according to the present invention has better performance than burners in the prior art, particularly with regard to the nitrogen oxide content of the off gases.

According to the present invention, a fuel introduction device is provided including a first means for injecting combustible fluid such as gas in the form of a jet which is substantially axial or slightly diverging with respect to the burner axis, and a second means for injecting a fluid such as gas in the form of a second jet diverging with respect to the burner axis.

The hearth burner according to the present invention has a primary gun for introducing a primary comburant i.e. a combustion-supporting substance, a secondary gun for producing a secondary comburant, a device for introducing a fluid fuel, particularly a gaseous fuel, and a baffle-stabilizer located essentially at the end of the primary gun facing the hearth.

A fuel introduction device can be mounted inside the primary gun which itself may be located inside the secondary gun, with the primary gun, secondary gun and fuel introduction device being cylindrical and coaxial.

The fuel introduction device may have an injector which itself has a first series of orifices forming the first fluid injection means and a second series or orifices forming the second fluid injection means. The injection axis of each of the orifices of the first series may form an angle $\alpha$ less than 15° with respect to the direction defined by the burner axis. The axis or each orifice in the second series may form an angle $\beta$ between 40° and 60° with the direction defined by the burner axis.

The angle $\alpha$ of each of the orifices of the first series may be between 10° and 15°, preferably 12.5°. The angle $\beta$ of each orifice in the second series may be substantially approximately 50°.

The axis of the orifices of the first series may be substantially inscribed on the surface of a cone or a cylinder. Thus, the first jet will have substantially the shape of frustroconical sheet.

The axes of the orifices of the second series may also be substantially inscribed on the surface of a cone. Thus, the second jet will also have substantially the shape of the second jet will also have substantially the shape of frustroconical sheet.

At its end leading into the hearth, the secondary gun may have a converging section designed to direct the secondary comburant toward the primary comburant/

The fuel introduction device may comprise a pipe at the end of which the first and second gas injecting means may be attached.

The present invention also relates to a process for burning comburant gas, such as oxygen, with the fuel gas such as natural gas. The comburant gas is introduced into the hearth in at least two streams, one being central and the other surrounding this central stream.

According to the process according to the invention, two fuel gas jets are produced, with one of the jets supplying the central comburant gas stream and the other jet supplying the other comburant gas stream.

According to one important aspect of the present invention, the axial or slightly diverging jet and the diverging jet do not interfere with each other when leaving the injector and retain their individuality at this point. This can be achieved in particular by having diverging jets surround the slightly diverging axial jet.

BRIEF DESCRIPTION OF THE DRAWINGS.

The present invention will be better understood and its advantages will emerge more clearly from the description hereinbelow of a particular example, illustrated by the attached figures, wherein.

DETAILED DESCRIPTION:.

The device described hereinbelow as a non-limited example is directed to a gas burner using a gaseous fuel such as natural gas, with the gas burner being provided in a hearth H which may be either an industrial or domestic hearth.

Figure 1:
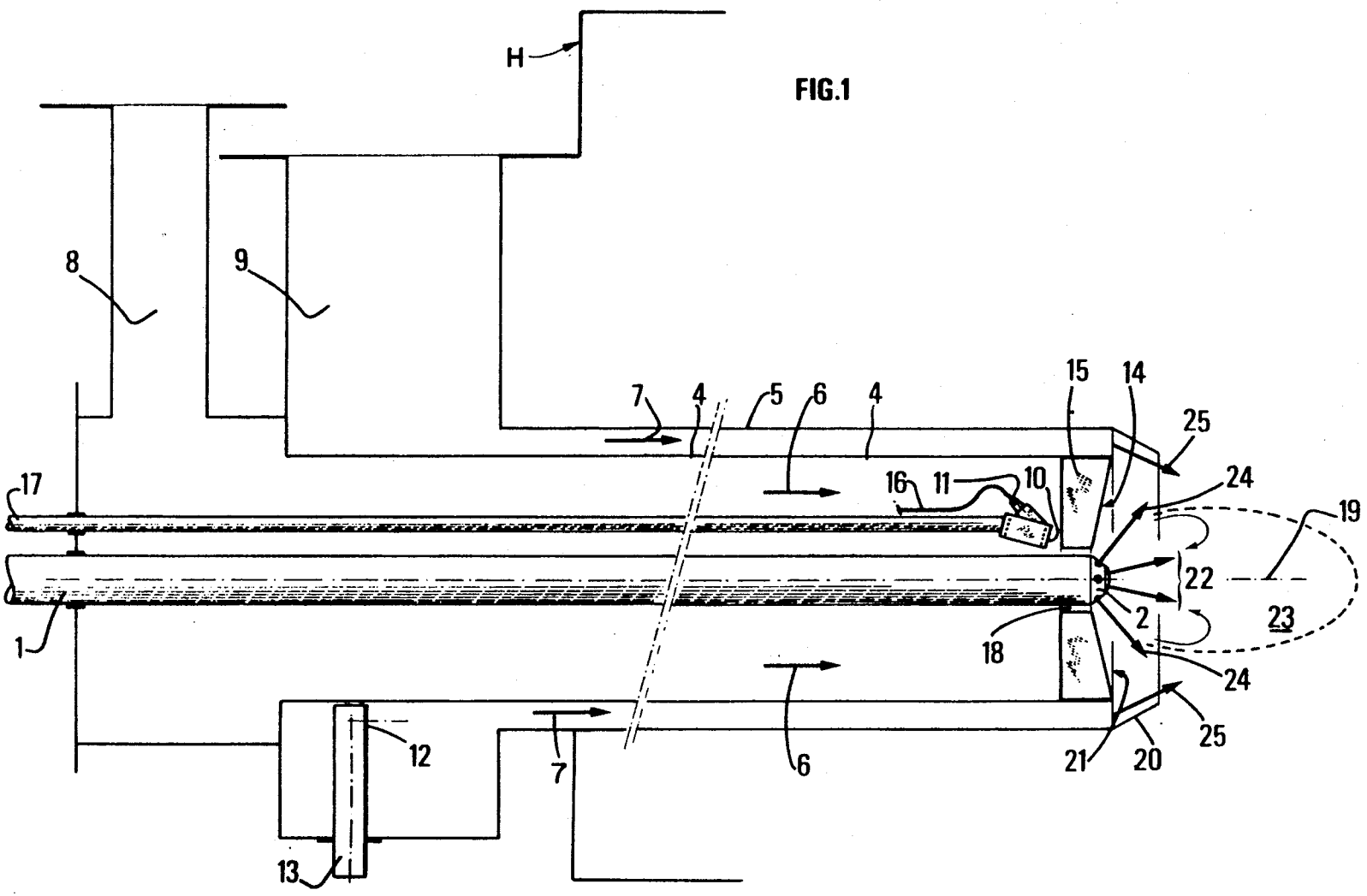
FIG. 1 is a schematic view of a gas burner.

In FIG. 1, a gas inlet pipe 1 feeds a gas injector 2.

The burner comprises at least one primary air or comburant inlet line, or primary gun 4, and one secondary air or comburant inlet line, or secondary gun 5, with the primary gun 4 being located inside the secondary gun 5, and with the guns 4, 5 being essentially cylindrical and coaxial. The gas injection pipe 1 is located inside the primary gun 4, with the arrow 6 designating a primary air stream and the arrow 7 designating a secondary air stream.

Primary and secondary air inlets 8, 9 may have different shapes from that shown in FIG. 1, in particular, to minimize load losses. Of course two inlets 8, 9 can be connected to the same air source or to different sources, possibly via elements, for example, one or more flaps (not shown) allowing the distribution of air between two inlets 8, 9 to be controlled.

Distribution may be such that the primary air can represent 35 to 70 percent of the total air, yet the optimal settings with respect to combustion are between 40 and 60%. In the remainder of this text, the primary air flow will be designated $Q_p$, the secondary air flow will be $Q_s$, and the total air flow $Q=Q_p+Q_s$.

The burner in FIG. 1 is ignited by an igniter 10 having ignition means such as a spark plug connected to a high-voltage source via a cable 16. The igniter 10 is fed with fuel by a line, which fuel may be of the same nature of the gas supplying the burner.

A location 13 provided in the burner, essentially at the level of the secondary air inlet 9 allows for mounting a flame detection cell 12.

The burner head illustrated in FIG. 1 includes a baffle-stabilizer generally designated by the reference numeral 14 simply called a "baffle" hereinbelow, with the baffle having a grid of blades 15 whose angle of inclination to the axis is preferably about 45°. Blades 15, 18 of them, for example, may be plain, or preferably have a semi-curvilinear profile which allows the intrinsic load loss factor, and hence the motive pressure of the air at high heat flows, to be reduced.

The baffle 14 may be disposed coaxially to the fuel inlet pipe 1 such that the scavenging air passage 18 may be provided at right angles to the gas injector 2.

The burner head may have a frustroconical converging section 20 designed properly to direct the secondary air flow 7.

In FIG. 1, the major base of the frustroconical converging section is located essentially in the plane perpendicular to the axis 19 of the burner, going through the end of the primary gun 4, with front ends of the blade heads lying essentially in this same plane.

The gas injector according to the present invention allows very slightly diverging, or axial, gas jets 22 to be obtained, preferentially supply the central stabilization vortex 23 created by the baffle 14, and strongly diverging external gas jets 24 which supply the secondary air stream preferentially. The axial or slightly diverging jet and the diverging jet retained their individuality with respect to each other at the level of the injector.

The gaseous fuel residence time, conditioned by the angle $\alpha$ of the central axial gas jets 22, govern the richness of the primary combustion for a fixed distribution between fixed ratio $Q_p/Q$.

The angle of external jets governs the speed with which the gaseous fuel encounters the secondary air stream 25, which may be essentially axial and hence delay to a greater or lesser degree the start of the secondary combustion "Axial secondary air stream" is understood to mean that the air exiting from the secondary gun 5 has no or practically no swirling motion about the burner axis 19.

Thus, it may be considered that the burner with two air streams, equipped with a gas pipe as described, constitutes a system which divides combustion into stages both by distributing the air and by distributing the fuel. This explains the relative performance with low $NO_x$ emissions when the $Q_p/Q$, $\alpha$ and $\beta$ are chosen correctly.

Figure 2:
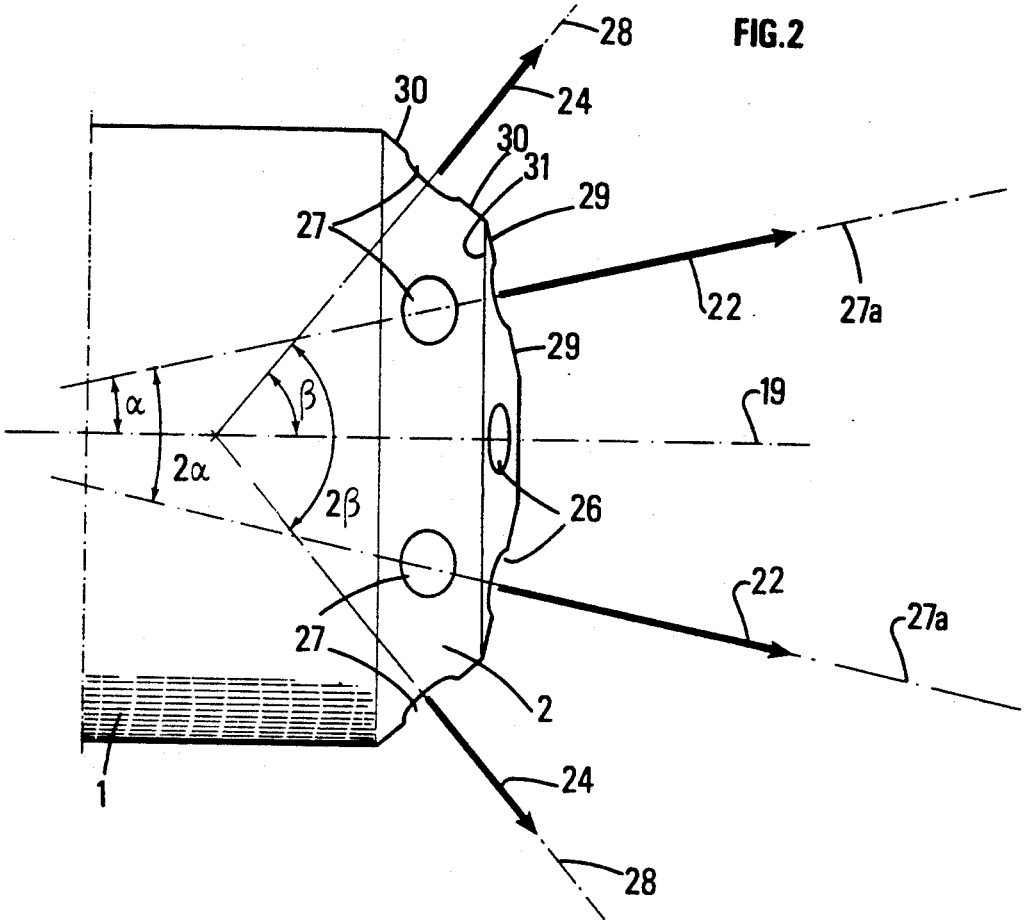
FIG. 2 is a plan view of an end of one embodiment of an injector in accordance with the present invention.

As shown in FIG. 2, the gas injector 2 is provided with a first series of holes 26 constituting the first circle having axes 27*a* which form an angle $\alpha$ between 0° and 15° with respect to the direction of a burner axis 19. Good results have been obtained when the angle $\alpha$ is between 10° and 15°, particularly for an angle of 12.5°.

Axes 27*a* of the holes 26 in the first circle are inscribed on a cone whose vertex angle is $2\alpha$ and is thus between 0° and 30°.

The holes in the second series of holes 27 constituting the second circle have axes 28 which form an angle $\beta$ of between 40° and 60° with respect to the burner axis 19. Good results have been obtained when the angle b is 50°.

Axes 28 of the holes 27 are inscribed on a cone whose vertex angle is 2*b* and is this between 80° and 120°.

Holes 26 on the first circle are located on a first frustroconical surface 29 of the burner head. Likewise, holes 27 on the second circle are located on a second frustroconical surface 30 of the burner head. Holes 26, 27 can be perpendicular to frustroconical surfaces 29 and 30, respectively. In FIG. 2, the first and second frustroconical surfaces 29 and 30 are connected at a circle 31.

According to one important aspect of the present invention, the axial or slightly diverging jet does not interfere with the diverging jet in the vicinity of the injector. This is achieved, for example, by locating the first series of holes 26 inside the second series of holes 27.

Figure 3:
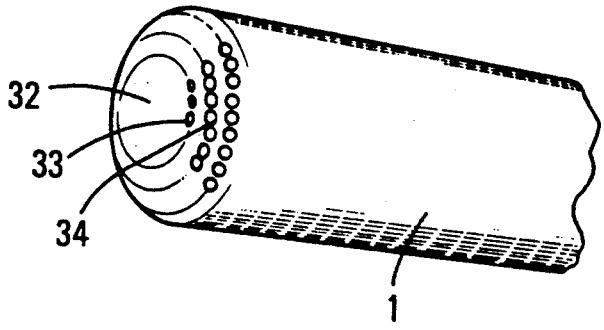
FIG. 3 is an oblique perspective view of an end of another embodiment of an injector according to the present invention.

In FIG. 3, the gas injector 2 has the form of a flattened cap 32 and has a double circle of holes 33, 34 for introducing the first jet and a single circle of holes 35 for introducing the second jet.

According to the embodiment of FIG. 3, the number of first jet inlet holes is essentially equal to the number of second jet inlet holes, with the total number of holes in the embodiment of FIG. 3 being essentially equal to 90 and the holes having the same diameter.

According to particular advantageous embodiment, the

According to particular advantageous embodiment, the burner according to the invention is designed so that the reaction zone of the burner nose or primary zone has a comburant/fuel ratio less than the same ratio relative to the secondary zone corresponding essentially to the zone where combustion is continued and completed. Thus, the fuel richness is greater in the primary zone than in the secondary zone.

Preferably, this richness would be greater in the primary zone than that corresponding to the stoichiometric reaction. Thus, the primary zone will have more fuel than necessary to consume the comburant arriving at this primary zone.

These conditions can be met both by distribution of the comburant flow between the primary and secondary streams and by the geometric configuration of the injector, i.e. the spatial distribution of the jet and/or sections of the fuel passages.

What is claimed:

1. Process for burning fuel gas with comburant gas, the process comprising the steps of introducing the comburant gas into a hearth in at least one substantially central comburant gas stream and at least one additional comburant gas stream convergent toward the at least substantially central comburant gas stream, producing at least two jets of fuel gas, from a single fuel introduction means, supplying one of said at least two jets of fuel gas to the substantially central comburant gas stream, and supplying the other of said at least two jets of fuel gas to the at least one additional comburant gas stream.

2. A burner for a hearth comprising a first means for introducing a primary comburant into the hearth, a second means for introducing a second comburant into the hearth, a fuel introducing means for introducing a fuel into the hearth, baffle-stabilizer means located essentially at an end of said first means facing the hearth, wherein said fuel introducing means terminates in an end portion facing the hearth, said end portion including an end surface comprising the first fuel injection means provided in said end surface for injecting a first jet of fuel into the hearth substantially axially or slightly diverging with respect to a longitudinal center axis of the burner, and second fuel injection means provided in said end surface for injecting a second jet of fuel into the hearth diverging relative to the longitudinal axis of the burner, and wherein means are disposed at an end of said second means for introducing the second comburant and for directing a flow of the second comburant inwardly toward the longitudinal center axis of the burner.

3. A burner according to claim 2, wherein said first fuel injection means and said second fuel injection means are constructed so that, in a first reaction zone located in an area surrounding the first and second fuel injection means, a comburant/fuel ratio is less than.

4. A burner according to claim 2, wherein said first fuel injection means and said second fuel injection means are constructed such that, in a first reaction zone located in an area surrounding the first and second fuel injection means, a comburant/fuel ratio is less than that of a comburant/fuel ratio of a secondary zone essentially corresponding to a combustion zone of the burner.

5. A burner according to claim 4 wherein said fuel introducing means is disposed inside said first means for introducing the primary comburant, the first means is located inside said second means for introducing the secondary comburant, and wherein said fuel introducing means, the first means for introducing the primary comburant, and the second means for introducing the secondary comburant are essentially cylindrical and coaxially disposed.

6. A burner according to claim 2, wherein said first fuel injection means includes a first series of holes formed in said end surface, said second fuel injection means includes a second series of holes formed in said end surface at a position axially spaced from said first series of holes, a center axis of each of the holes of the first series of holes forms, with a direction defined by the longitudinal center axis of the burner, an angle $\alpha$ less than 15°, and wherein an axis of each of the holes in the second series of holes forms, with the direction defined by the longitudinal center axis of the burner, an angle $\beta$ of between 40° and 60°.

7. A burner according to claim 6, wherein the angle $\alpha$ is between 10° and 15°.

8. A burner according to claim 7, wherein the angle $\alpha$ is substantially equal to 12.5°.

9. A burner according to claim 7, wherein the angle $\beta$ is approximately 50°.

10. A burner according to claim 9, wherein the end surface is one of conical, and wherein the axis of the holes in the first series of holes are essentially inscribed on the conical or cylindrical surface.

11. A burner according to claim 10, wherein the end surface is conical, and wherein the axis of the holes in the second series of holes are essentially inscribed on the conical surface.

12. A burner according to claim 2, wherein said means for introducing the fuel further includes a pipe terminating in said end surface.

13. A burner according to claim 2, wherein said means for directing a flow of the second comburant includes a converging section provided at one end of the first means for introducing the primary comburant.

14. A burner according to claim 3, wherein said first fuel injection means includes a first series of holes formed in said end surface, said second fuel injection means includes a second series of holes formed in said end surface at a position axially spaced from said first series of holes, a center axis of each of the holes of the first series of holes forms, with a direction defined by the longitudinal center axis of the burner, an angle $\alpha$ less than 15°, and wherein an axis of each of the holes in the second series of holes forms, with the direction defined by the longitudinal center axis of the burner, an angle $\beta$ of between 40° and 60°.

15. A burner according to claim 14, wherein the angle $\alpha$ is between 10° and 15°.

16. A burner according to claim 15, wherein the angle b is approximately 15°.

17. A burner according to claim 16, wherein the end surface is one of conical, and wherein the axis of the holes in the first series of holes are essentially inscribed on the conical or cylindrical surface.

18. A burner according to claim 17, wherein the end surface is conical, and wherein the axis of the holes in the second series of holes are essentially inscribed on the conical surface.

* * * * *